United States Patent [19]

Gwozdz

[11] 4,110,867

[45] Sep. 5, 1978

[54] RETRACTABLE DOOR STOP FOR BIDIRECTIONAL SWINGING DOOR

[75] Inventor: Joseph W. Gwozdz, Clark Summit, Pa.

[73] Assignee: McKinney Manufacturing Company, Scranton, Pa.

[21] Appl. No.: 851,468

[22] Filed: Nov. 14, 1977

[51] Int. Cl.[2] ..... E05F 5/02

[52] U.S. Cl. ..... 16/82; 49/141; 292/228

[58] Field of Search ..... 16/48.5, 82, 85; 49/141; 292/228

[56] References Cited

U.S. PATENT DOCUMENTS

| | | | |
|---|---|---|---|
| 2,890,475 | 6/1959 | Carlson | 16/82 |
| 3,105,992 | 10/1963 | Carlson | 49/141 X |
| 3,172,168 | 3/1965 | Suska | 16/82 X |
| 3,862,774 | 1/1975 | Johnson | 16/82 |
| 3,946,460 | 3/1976 | Johnson | 16/82 |

FOREIGN PATENT DOCUMENTS

| | | | |
|---|---|---|---|
| 383,822 | 1/1965 | Switzerland | 16/82 |

*Primary Examiner*—Ronald Feldbaum
*Attorney, Agent, or Firm*—Brown, Flick & Peckham

[57] ABSTRACT

A housing with an open outer end engages the inner face of a faceplate around an opening through the plate, which is designed for attachment to a door jamb. A spring in the housing normally holds a plunger in a position in which it projects from the faceplate. The projecting portion of the plunger has a laterally facing abutment for engagement by a bidirectional swinging door when the door is closed in its normal closing direction. Pivotally connected to the plunger on a vertical axis adjacent the outer end of the housing at its door side is a lever that has a latch portion projecting from the opposite side of the plunger and engaging the inner face of the faceplate. The lever also has a second portion normally extending out of the faceplate opening for engagement by a finger to swing the lever toward the door side of the housing, whereby to push the plunger rearwardly in the housing to retract the abutment and move the outer end of the latch portion into engagement with the adjacent side of the faceplate opening to hold the plunger retracted until released by manually swinging the lever in the opposite direction.

8 Claims, 8 Drawing Figures

RETRACTABLE DOOR STOP FOR BIDIRECTIONAL SWINGING DOOR

In some installations of bidirectional swinging doors a stop is provided that prevents the door from swinging away from closed position in one direction. The stop is manually retractable so that, if desired, it can be moved out of the path of the door to permit the door to be swung past it so that the door can be opened in the direction opposite to its normal opening direction. Such arrangements are shown in U.S. Pats. Nos. 3,172,168 and 3,946,460. Retractable stops for swinging doors are especially useful in hospitals, such as for the lavatories and bathrooms. The doors normally open into those rooms and in closed position engage the retractable stops. If a patient faints or falls against the door so that the door cannot be swung inwardly to open it, an attendant can retract the stop and then swing the door outwardly. The door stops shown in the above patents are not locked in retracted position.

It is among the objects of this invention to provide a retractable door stop for a bidirectional swinging door, which is automatically locked in its retracted position until released manually, which is easily released, which avoids any possibility of pinching the finger of the person retracting the stop, and which is simple and dependable in construction and operation.

The invention is illustrated in the accompanying drawings, in which

Figure 2:
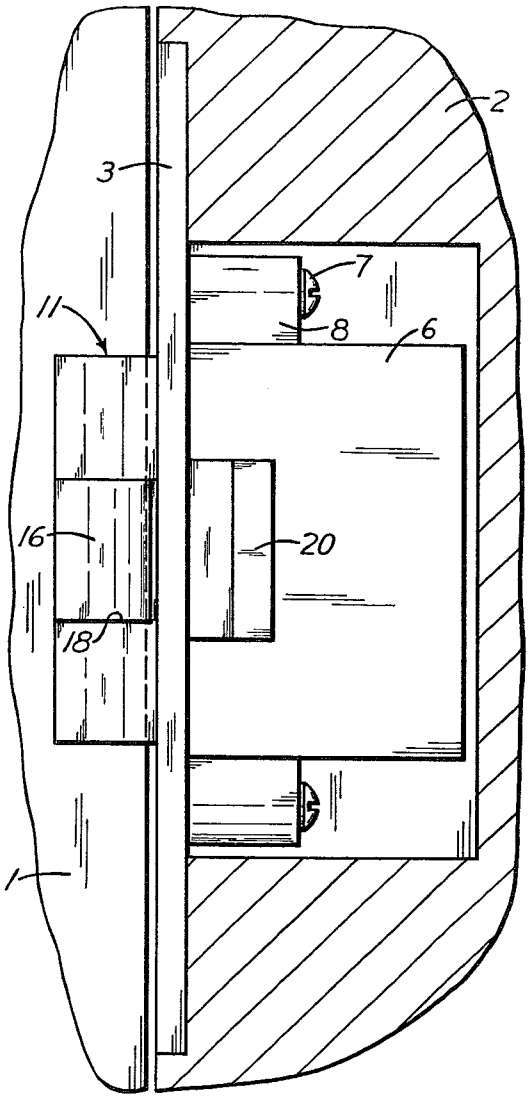
FIG. 2 is a side view.

Referring to the drawings, a door 1 is shown in FIGS. 1, 4, 5 and 6 that is hinged in such a manner that it can be swung open in either direction from a closed position, in which its free edge is located beside the jamb 2 of a doorway. The door is provided with knobs or handles (not shown) on its opposite sides. It is assumed that the door is intended in normal use to be opened in only one direction, by swinging it into a room where an emergency may arise that will require the door to be opened in the opposite direction.

Figure 3:
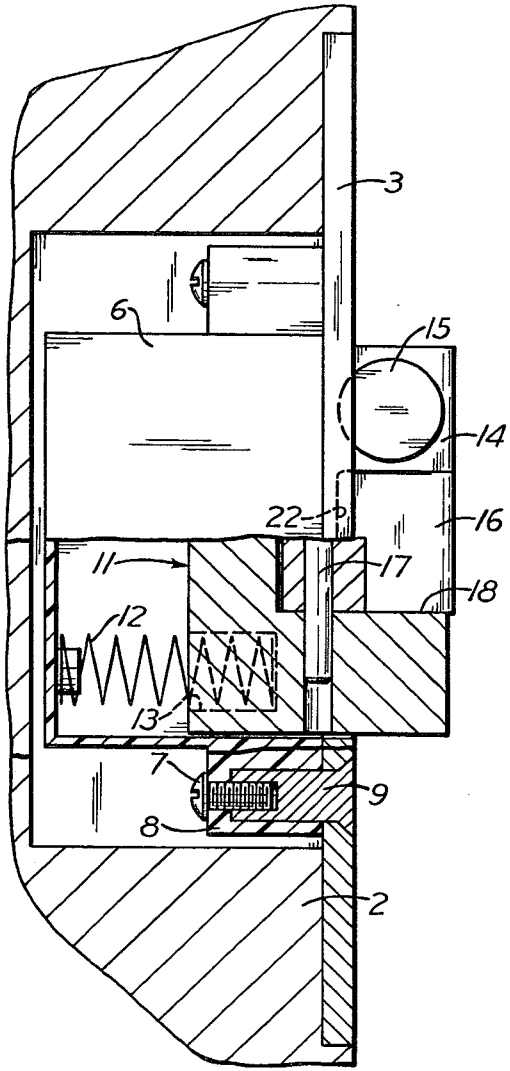
FIG. 3 is a view of the opposite side, partly broken away in section.

Mortised into the door jamb is a vertical faceplate 3 provided with a rectangular opening 4 through it registering with an opening in the jamb and any material directly behind it. Engaging the back or inner face of the plate is a generally rectangular housing 6 having an open front or outer end surrounding the faceplate opening. This housing is attached to the plate, such as by screws 7 extending through bosses 8 at the top and bottom of the housing and into threaded holes in studs 9 (FIG. 3) projecting from the back of the faceplate into the bosses.

Figure 4:
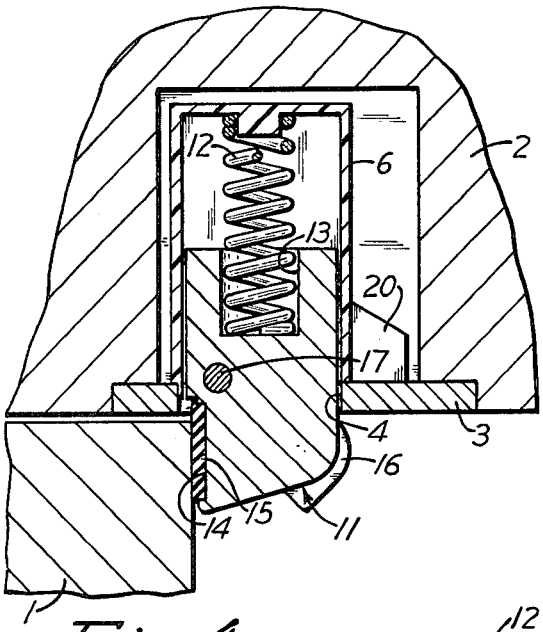
FIGS. 4 and 5 are horizontal sections taken on the lines IV—IV and V—V, respectively, of FIG. 1.
Figure 5:
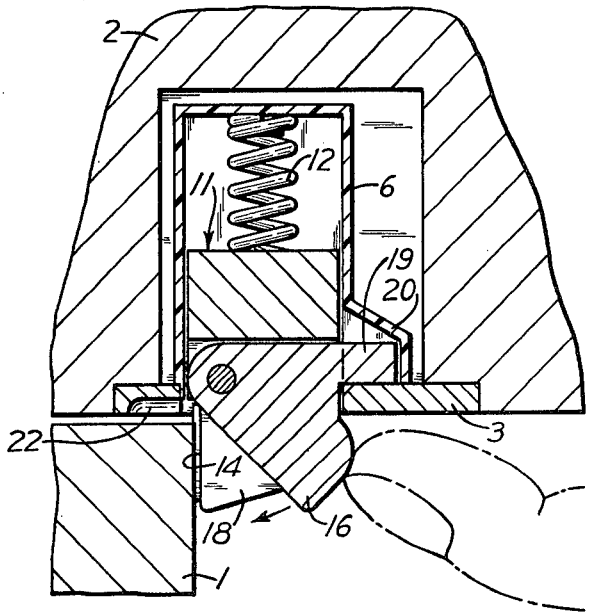

Slidably mounted in housing 6 is a plunger 11 that normally extends through the faceplate opening and projects from the outer face of the plate. In that position the inner end or back of the plunger is spaced from the back wall of the housing, and in the space between them are upper and lower partly compressed coil springs 12 that normally hold the plunger in its projecting position. Preferably, one end of each spring extends into a socket 13 in the back of the plunger. The projecting outer end of the plunger has a vertical side surface 14 facing the outer side of the closed door to form an abutment that stops the door from swinging outwardly beyond its closed position, as shown in FIGS. 4 and 5. Resilient bumper means 15 may be attached to this laterally facing abutment. As described thus far, it will be seen that the door can be opened only by swinging it inwardly away from the door stop, to the left in FIG. 4.

Figure 1:
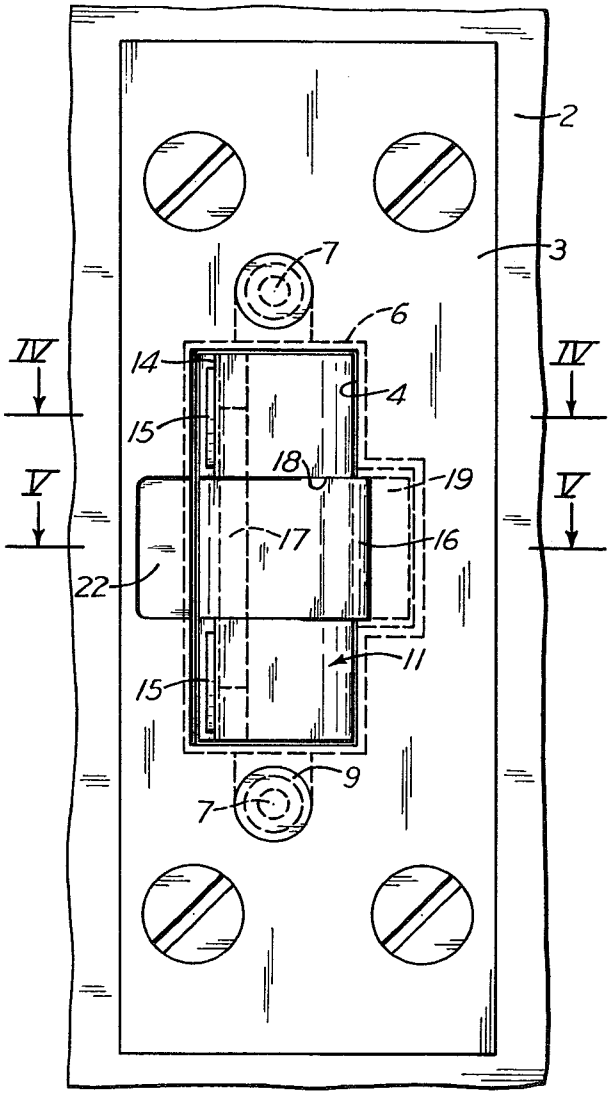
FIG. 1 is an elevation of the door stop mounted in a door jamb.

On the other hand, if a situation develops where it becomes desirable to be able to open the door in the opposite direction from the outside, provision is made for moving the plunger rearwardly in its housing to a retracted position where it will not prevent the door from swinging outwardly past it. This movement or retraction of the plunger is accomplished by means of a lever 16 that is pivotally connected by a vertical pivot pin 17 to the plunger adjacent the outer end of the housing at the door side of the housing. By "the door side" is meant the side of the housing that is adjacent the door when it is closed. Preferably, the plunger abutment is provided midway between its upper and lower ends with a slot 18 through it that divides it into a pair of vertically spaced abutment portions as shown in FIG. 1. The lever is disposed in this slot and extends across the plunger and out of the faceplate opening and projects from the side of the plunger opposite the pivot pin. The outer end of the lever can be engaged by a finger and swung inwardly toward the closed door. As shown in FIG. 5, the lever also has an integral latch portion 19 engaging the inner face of the faceplate at the side of opening 4 opposite the pivot pin, the side of the housing being provided with a lateral extension 20 receiving this latch portion. While the door stop is in operative position the back wall of slot 18 engages the back of the lever, thereby limiting the distance the plunger can project from the faceplate.

Figure 6:
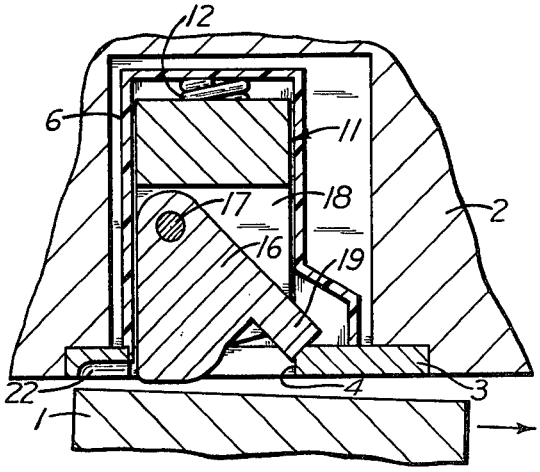
FIG. 6 is a view similar to FIG. 5, but with the door stop retracted.

To move the plunger out of door-stopping position, a finger of a person outside the door is pressed against the projecting end of the lever and it is pushed toward the opposite side of the plunger. If the finger pressure is applied at an angle to the faceplate, the pressure will also cause the lever to push the plunger back into the housing. If the finger pressure is applied to the lever in a direction parallel to the faceplate, the lever not only will pivot in the plunger but it also will fulcrum on the end of its latch portion 19 bearing against the faceplate, thereby pushing the plunger rearwardly in the housing. As this occurs, the latch portion of the lever slides along the faceplate toward opening 4 and then slides out into that opening a short distance so that it engages the side wall of the opening. This engagement of the end of the latch portion with the side of the opening also occurs when the lever is pressed at an angle to the faceplate. In either case, as soon as the lever strikes the opposite side of the opening and can be moved no farther, the finger is withdrawn. Engagement of the latch with the side of the opening prevents the springs from pushing the plunger forward when the finger is removed from the lever. In their retracted positions, both the plunger and the lever are out of the path of movement of the door as shown in FIG. 6, which then can be swung outwardly past the door stop without interference from it. It will be seen that since the plunger is locked in its retracted position the finger can be removed from the lever before the door is pulled outwardly, so there is no danger of the door pinching the finger.

To return the stop to operating position, all that it is necessary to do is to swing the door back past the retracted plunger far enough to permit the tip of the finger to engage the outer corner of the far side of the lever and pull on it to swing the latch out of contact with the side of the faceplate opening. The coil springs will then immediately project the door-stopping abutment from the faceplate. To aid in releasing the lever, the faceplate at the door side may be provided with a shallow recess 22 beside the lever so that more of the side of the lever will be exposed to contact by the finger.

Figure 7:
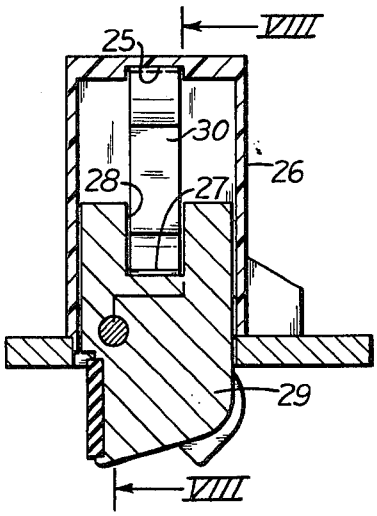
FIG. 7 is a horizontal section like FIG. 4, but of a modification.
Figure 8:
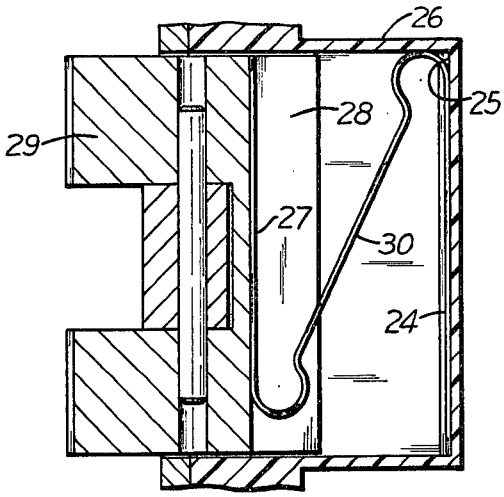
FIG. 8 is a vertical section taken on the line VIII—VIII of FIG. 7.

A coil spring is not the only type of spring that can be used. For example, a leaf spring is equally satisfactory. As shown in FIGS. 7 and 8, such a spring can be bent to form a straight vertical rear portion 24 that seats in a vertical groove 25 in the inner wall of the plunger housing 26. The front portion 27 of the spring also is straight and vertical and fits in a vertical slot 28 in the inner end of the plunger 29. The lower end of this portion and the upper end of the rear portion of the spring are connected by an integral inclined intermediate portion 30 of the spring. The action of this modification is exactly the same as the one described first.

According to the provisions of the patent statutes, I have explained the principle of my invention and have illustrated and described what I now consider to represent its best embodiment. However, I desire to have it understood that, within the scope of the appended claims, the invention may be practiced otherwise than as specifically illustrated and described.

I claim:

1. A retractable door stop for a bidirectional swinging door, comprising a faceplate for attachment to a door jamb and having inner and outer faces and an opening therethrough, a housing adapted to extend into a door jamb and having an open outer end engaging the inner face of the faceplate around said opening, a plunger slidably mounted in the housing and normally projecting from the outer face of the faceplate into door-stopping position, a spring in the housing behind the plunger normally holding the plunger in said position, the plunger having a laterally facing abutment for enagement by a door when closed in its normal closing direction, and a combination lever and latch pivotally connected to the plunger on a vertical axis and normally extending out of the faceplate opening for engagement by a finger to swing the lever toward the door side of the housing to simultaneously push the plunger rearwardly in said housing and move the latch into latching position, whereby to hold the plunger retracted until released by manually swinging the lever in the opposite direction.

2. A retractable door stop according to claim 1, in which the inner end of said plunger is provided with a socket, and said spring is a coil spring projecting from the socket and compressed between the plunger and the inner end of said housing.

3. A retractable door stop according to claim 1, in which said spring is a reversely bent leaf spring compressed between said plunger and the inner end of said housing.

4. A retractable door stop according to claim 1, in which said abutment is divided into a pair of vertically spaced abutment portions, and said combination lever and latch is disposed between the abutment portions of the plunger.

5. A retractable door stop according to claim 1, in which said plunger normally engages the back of said combination lever and latch to limit outward movement of the plunger.

6. A retractable door stop according to claim 1, in which said vertical axis is adjacent the outer end of said housing at the door side thereof.

7. A retractable door stop according to claim 6, in which the outer face of said faceplate is provided with a recess beside said combination lever and latch at the door side of said housing.

8. A retractable door stop according to claim 6, in which said combination lever and latch has a latch portion projecting from the side of the plunger opposite said door side of said housing and engaging the inner face of said faceplate, the outer end of said latch portion being movable into engagement with the adjacent side of said faceplate opening to hold the plunger retracted.

* * * * *